United States Patent [19]

Dufour et al.

[11] 4,347,788

[45] Sep. 7, 1982

[54] PLATE LOCKUP MECHANISM

[75] Inventors: Charles H. Dufour, Westerly, R.I.; W. Robert Gelinas, Jewett City, Conn.; Michael J. Stankosky, North Stonington, Conn.; Bohdan D. Washchynsky, Pawcatuck, Conn.

[73] Assignee: Harris Corporation, Melbourne, Fla.

[21] Appl. No.: 145,438

[22] Filed: May 1, 1980

[51] Int. Cl.[3] ..... B41F 27/12

[52] U.S. Cl. ..... 101/415.1

[58] Field of Search ..... 101/415.1, 378

[56] References Cited

U.S. PATENT DOCUMENTS

| | | | |
|---|---|---|---|
| 3,012,841 | 12/1961 | Antere et al. | 101/415.1 |
| 3,043,219 | 7/1962 | Dietrich | 101/378 |
| 3,335,663 | 8/1967 | Harenze | 101/415.1 |
| 3,382,799 | 5/1968 | Luehrs | 101/415.1 |
| 3,452,674 | 7/1969 | Porter | 101/378 |
| 3,626,848 | 12/1971 | Tafel et al. | 101/415.1 |
| 3,659,525 | 5/1972 | Woessner et al. | 101/378 |
| 3,727,551 | 4/1973 | Kostas et al. | 101/415.1 |
| 3,752,075 | 8/1973 | Fusco | 101/415.1 |
| 4,154,167 | 5/1979 | Czinger | 101/415.1 |

FOREIGN PATENT DOCUMENTS

| | | | |
|---|---|---|---|
| 2017416 | 6/1973 | Fed. Rep. of Germany | 101/415.1 |
| 2522061 | 11/1976 | Fed. Rep. of Germany | 101/415.1 |
| 654399 | 12/1977 | Fed. Rep. of Germany | 101/415.1 |
| 1230898 | 5/1971 | United Kingdom | 101/415.1 |

*Primary Examiner*—William Pieprz

*Attorney, Agent, or Firm*—Yount & Tarrolli

[57] ABSTRACT

A plate lockup mechanism secures a printing plate to a printing cylinder. The mechanism includes two movable members disposed within the printing cylinder. Means connected with one of said members engages one end portion of the printing plate to secure the one end portion of the plate on the cylinder and means connected with the other of said members secures the other end of the plate to the cylinder. Each of the members is movable between first and second extreme positions. A biasing spring coacts between the two members and urges one of the members to either one of its extreme positions when the other member is in its first extreme position and when the other member is in its second extreme position.

12 Claims, 14 Drawing Figures

PLATE LOCKUP MECHANISM

BACKGROUND OF THE INVENTION

The present invention relates to a plate lockup mechanism for use in securing a printing plate to a printing cylinder.

Various means have been used in the past to secure a flexible printing plate to a printing cylinder. Plate lockup mechanisms are generally located within a gap in the printing cylinder. The printing plate is wrapped around a cylinder, and the opposite ends of the plate are inserted into the gap to be engaged by the lockup mechanism. The smaller the gap in the cylinder, the larger the print area for a given size cylinder, or for a given print area, the plate cylinder and consequently the entire press, may be made smaller.

The presence of the gap in the cylinder causes the cylinder to vibrate as the gap rotates through a nip formed by the printing cylinder and a cooperating cylinder. In order to minimize this vibration, it is desirable that the gap in the cylinder through which the ends of the printing plate are inserted be as small as practicable. U.S. Pat. Nos. 2,775,198 and 3,012,841 show typical plate clamp mechanisms.

Also an additional consideration in the design of a plate lockup mechanism is that in many presses the cylinders may be rotated in either direction depending on what path a web to be printed on takes through the press. Accordingly, it is desirable for a plate lockup mechanism to be effective regardless of the direction of rotation of the cylinder. Further, it is desirable for a plate clamp mechanism to be able to be used in presses where plural plates are located circumferentially around the cylinder. U.S. Pat. Nos. 1,795,700; 1,795,702; and 3,727,551 disclose such plate lockup mechanisms.

SUMMARY OF THE INVENTION

The present invention provides a new and improved plate lockup mechanism which is effective to secure and accurately position a printing plate on a printing cylinder. The plate lockup mechanism of the present invention provides a uniform predetermined tension to the printing plate. The present invention also provides for a relatively small gap in the surface of the printing cylinder thus increasing the print area for a given cylinder size. Further, the plate lockup mechanism constructed in accordance with the present invention may be located in a cylinder gap and is effective to secure plural plates to a printing cylinder, which plates are circumferentially spaced around the printing cylinder, regardless of the direction of rotation of the cylinder.

Specifically, the present invention comprises a plate lockup mechanism which is located in an axially extending slot in a printing cylinder. A cylinder to which two printing plates are attached in a circumferentially spaced relationship to each other is provided with two such slots diametrically opposite each other in each of which is located a plate lockup constructed according to the present invention. Similarly, a cylinder with four plates would have four slots and four plate lockups, etc.

The edges of each slot in which a plate lockup is located are undercut and two movable members are disposed within the slot, one on each side of the slot. A gripper is associated with each of the movable members, and each is effective to engage one end portion of a printing plate. The member on the leading side of the slot and the gripper attached to it serve to engage the leading edge of the plate to hold it in place, while the member on the trailing edge of the slot and the gripper attached to it serve to apply a predetermined tension to the printing plate.

Each of the movable members in the slot has a rounded apex or tip, and these tips rest in opposing concavely curved portions of the slot in the cylinder. Each of the members is pivotable about its tip between upper and lower extreme positions. The apex-pivot in a concave surface minimizes or eliminates wear, friction and sticking. Further, this design is less subject to contamination than prior art plate lockups.

The leading edge of a printing plate may be hooked over the leading edge of the slot when the member (and the gripper connected with it) is in its lower extreme position. When the member is pivoted to its upper extreme position, the gripper presses a downwardly folded end portion of the plate against the edge of the slot to secure it in place. The trailing edge of the printing plate may be inserted into the slot when the member on that side of the slot is in its upper position. Thereafter, this member is pivoted to its lower position to bring the gripper into engagement with a hook formed in the trailing edge of the printing plate. The gripper then applies a predetermined pressure to the printing plate.

In one preferred embodiment the members are biased to either of their extreme positions by a single spring which coacts between them. The spring acts against each of the members so that each member has a toggle action, moving over a center position between the two extreme positions. Thus, if one of the members, e.g, the leading edge member is in its upper position, the spring will apply a force to bias it into that position. But, once that the member is moved over center toward its lower position, the spring will apply a biasing force urging the member toward the lower position. The spring is effective in this way regardless of the position of the other member, in this example the trailing edge member. Because each movable member is independently actuatable, each end of a printing plate may be secured to a cylinder independently, and this facilitates attachment where a number of plates are attached in circumferential sequence to a cylinder.

A plate lockup mechanism constructed according to a preferred embodiment of the present invention is effective regardless of the direction of rotation of the cylinder, and no modifications are required when the direction of cylinder rotation is reversed. Each slot in the cylinder is symmetrical about a radial line and the two movable members are mirror images of each other. For this reason, a single spring coacting between the two members is effective to enable each member to act as a toggle regardless of the position of the other member. Further, the grippers associated with each member are identical, each having a flat portion to press the leading edge of the printing plate against a wall of the slot and a hooked portion to engage the hooked trailing edge of the printing plate. In this way, either gripper may engage the leading edge of the printing plate and either gripper may engage the trailing edge of the printing plate, thus making the plate lockup mechanism reversible.

The plate lockup of the present invention is easily manufactured, installed, and serviced. The plate cylinder has a slot machined into its surface. No threaded holes or the like are required to hold the lockup in place. The movable members with attached grippers and the biasing spring may be easily inserted into the slot from either axial end. This is substantially different from other narrow-gap lockups which are installed from the curved face of the plate cylinder and which can require the use of filling pieces screwed to the plate cylinder to close the cylinder gap after installation of the lockup. The lockup of the present invention may be removed for repair or cleaning without removing the cylinder from the press. This greatly facilitates servicing the lockup.

BRIEF DESCRIPTION OF THE DRAWINGS

These and other essential features of the present invention will be apparent from the description below, and objects and advantages will be apparent to those skilled in the art to which the invention relates from the following description of a preferred embodiment of the present invention made with reference to the accompanying drawings in which.

DESCRIPTION OF A PREFERRED EMBODIMENT

Figure 1:
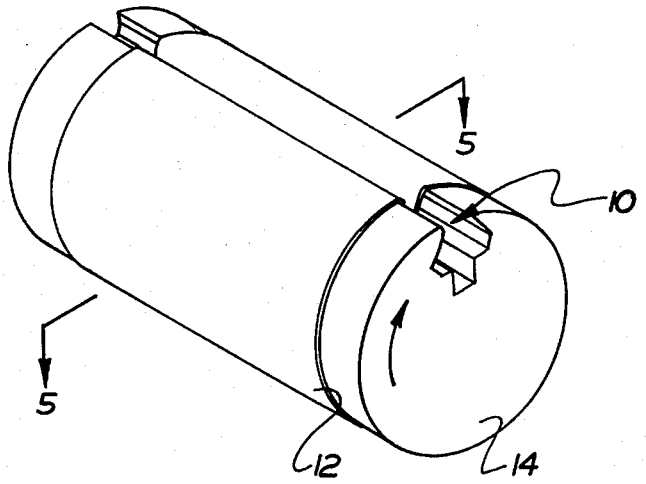
FIG. 1 illustrates a reversible printing cylinder on which a printing plate has been secured by a plate lockup mechanism constructed in accordance with the present invention.

The present invention relates to a plate lockup mechanism 10 for use in securing a flexible printing plate 12 to a printing cylinder 14. The plate lockup mechanism 10 constructed in accordance with the present invention is particularly suited for printing cylinders which may rotate in one direction during one press run and in another direction during another press run because the lockup mechanism of the present invention is symmetrical and is equally effective for both directions of rotation of the printing cylinder. Further, the present invention achieves a plate lockup mechanism 10 which is effective to secure printing plate 12 to a printing cylinder 14 in accurate registration with the printing cylinder, and the plate lockup mechanism applies a predetermined tension to the printing plate. In addition, it is contemplated that printing cylinders will be equipped with a plurality of plate lockup mechanisms of the present invention and that they may be spaced circumferentially and/or axially with respect to each other on the printing cylinder in order to secure a number of plates which do not extend the entire circumference and/or width of the printing cylinder.

A printing cylinder 14 (FIG. 2) equipped with a plate lockup mechanism 10 constructed according to the present invention is provided with a slot 16. Disposed within the slot are two movable members 20 and 22 to each of which is attached a gripper 24 and 26, respectively. Each movable member 20 and 22 has a roughly pentagonal cross section which includes a rounded apex or tip 30 and 32 which is received in a concavely curved surface 34 and 36 in the slot 10. The convexly curved tips 30 and 32 pivot on the concavely curved surfaces 34 and 36 and thus permit each movable member 20, 22 to pivot between an upper and lower extreme position. By way of illustration, the member 20 is shown in FIG. 2 in its lower extreme position, while the member 22 is shown in the same Figure in its upper extreme position.

To attach a printing plate 12 to the cylinder 14, it is only necessary to hook the leading end portion 40 of the printing plate over the edge 42 of the slot 16. Thereafter, the movable member 20 is shifted to its upper position (FIG. 3) so that the surface 46 of the gripper 24 engages the leading end portion 40 of the printing plate 12 and presses it against the side 48 of the slot 16. Thereafter, the trailing edge 52 of the printing plate 12 is inserted into the slot 16, and the movable member 22 is shifted to its lower extreme position (FIG. 3), and this brings the hook-like tip 56 of the gripper 26 into engagement with the bent-over hook 58 formed in the trailing 52 of the printing plate. The bend in the leading edge 40 of the printing plate 12 is accurately positioned with respect to the image on the printing plate. As a result, this hook, when held in place against the edge 42 of the slot 16 by the gripper 24 and by the tension applied to the plate by gripper 26, accurately positions the image relative to the printing cylinder.

A spring 64 extends between the movable members 20 and 22. The spring 64 biases the member 20 to either its upper extreme position (FIGS. 3 and 4) or to its lower extreme position (FIG. 2) regardless of the position of the member 22. Likewise, the spring 64 is effective to bias the movable member 22 to its upper position (FIGS. 2 and 3) or to its lower position (FIG. 4) without regard to the position of the movable member 20.

Figure 2:
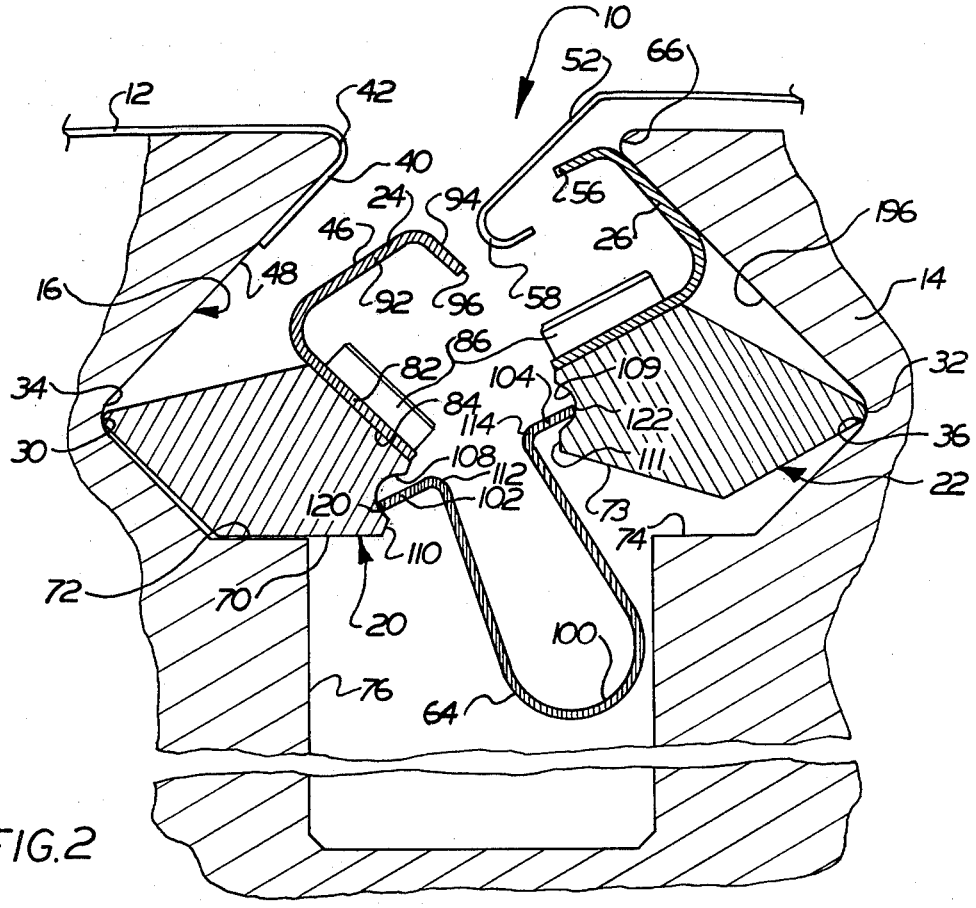
FIG. 2 is a sectional view of a portion of the printing cylinder shown in FIG. 1 and illustrating leading and trailing edges of a printing plate inserted into a slot in the printing cylinder before either has been engaged.
Figure 3:
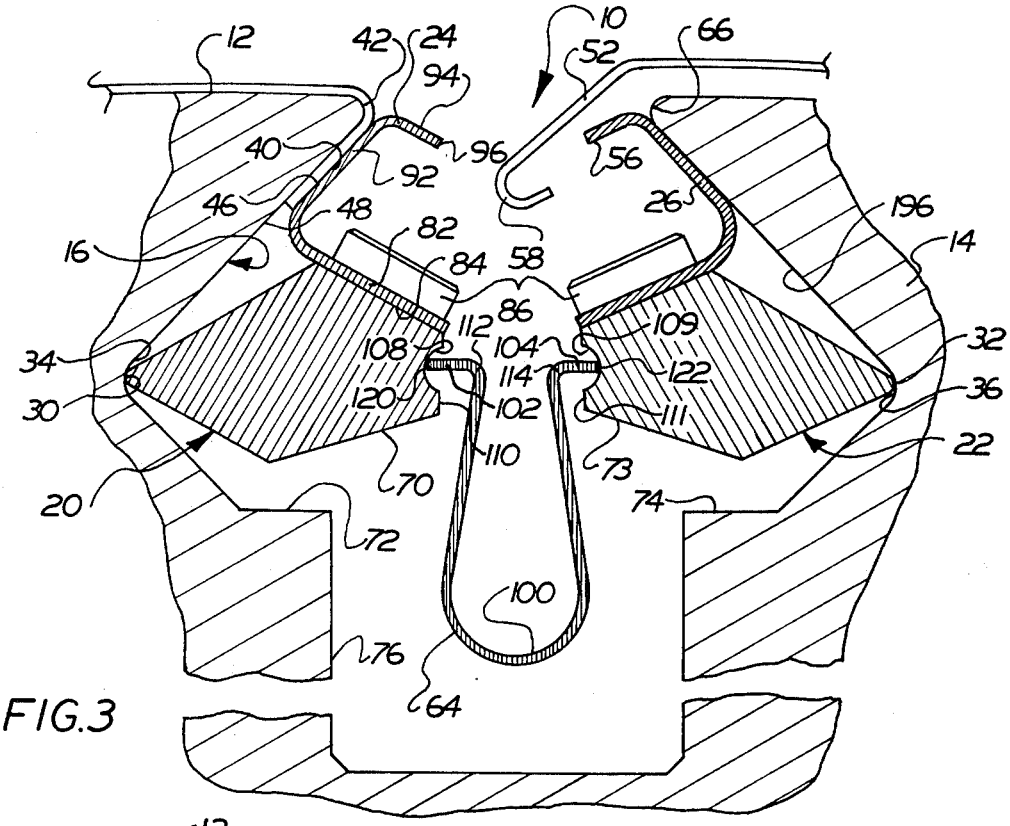
FIG. 3 is a sectional view similar to FIG. 2 but showing the leading edge of the printing plate engaged by the plate lockup mechanism.
Figure 4:
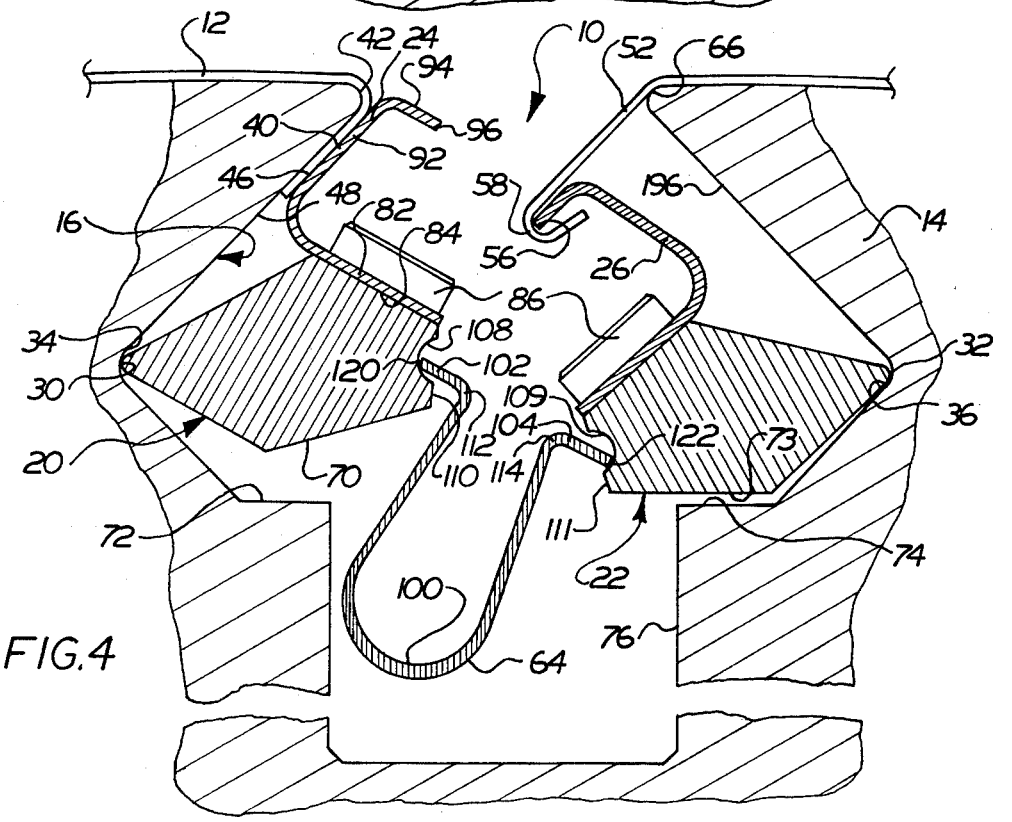
FIG. 4 is a sectional view similar to FIG. 3 but showing the leading and trailing edges of a printing plate engaged by a plate lockup mechanism constructed in accordance with the present invention.

As is shown most clearly in FIGS. 2–4, the slot 16 formed in the cylinder 14 is adapted to receive the plate lockup mechanism with a gap in the cylinder of minimum width. In this way, the vibration induced as the gap passes through a nip defined by the printing cylinder 14 and a cooperating cylinder (not shown) is reduced to a minimum. In practice, the gap in the surface of the cylinder 14 is on the order of $\frac{1}{2}$ inch.

As is clear from the preceding general description of the mode of operation of the lockup mechanism 10, the movable member 20 may rotate upward (counterclockwise as shown in FIG. 2) about the pivotal surface 34 until the surface 46 of the gripper 24 presses the leading end 40 of the printing plate 12 against the side 48 of the slot 16. The edges 42 and 66 of the slot 16 are a controlled radius which matches a controlled radius on the printing plate 12. These matched radii allow the plate 12 to be positively supported by the cylinder edge 42 and 66. This positive support then prevents flexing and cracking of the plate 12 as it is loaded and unloaded when coming in contact with mating rollers. From the rounded edge 42, the side 48 of the slot is undercut and presents a smooth flat surface against which the leading end portion 40 of the plate 12 may be pressed. At the radially inner end of the side 48 is the concavely curved pivotal surface 34 against which the tip 30 of the movable member 20 rocks. The radius of curvature of the pivotal surface 34 is larger than the radius of curvature of the tip 30 so that there is contact along an axially extending line between the movable member 20 and the pivotal surface 34.

Rotation of the movable member 20 downward (clockwise as viewed in FIGS. 2–4) is limited by contact between surface 70 of the movable member 20 and surface 72 of the slot 16. When the member 22 (FIG. 4) is moved toward its lowermost position, the face 73 (which corresponds to the face 70) of the member 22 does not reach the face 74 (which is symmetrical with the face 72) of the slot 16. Rather, the tip 56 of the gripper 26 engages the bent-over end 58 of the printing plate. The gap between surfaces 73 and 74 is provided to accommodate stretching of the printing plate 12 during the press run and, as will become more clear below, to enable the spring 64 to apply tension to the plate.

As pointed out above, the slot 16 is symmetrical about a radially extending line which extends from the center of the cylinder 14 and which bisects the gap in the surface of the cylinder 14. Therefore the motion of the movable member 22 is determined by the shape of the righthand side of the slot (as viewed in FIG. 2) in the same manner as the motion of the movable member 20 is determined by the shape of the lefthand side of the slot 16.

The grippers 24 and 26 are likewise symmetrical with each other and therefore a description of the gripper 24 is equally applicable to the gripper 26. The gripper 24 is formed of a resilient material such as spring steel and may be roughly C-shaped. The base 82 of the gripper 24 is generally straight and lies against the surface 84 of the movable member 20 to which it is connected by suitable threaded fasteners 86.

The back 92 of the gripper 24 includes the surface 46 which presses the end portion 40 of the printing plate 12 against the side 48 of the slot 16. The back 92 is bent at an angle to the base 82 such that when the movable member 20 is in its upper position (FIGS. 3 and 4), the surface 46 is substantially parallel to the side 48 of the slot 16. The top 94 of the C-shaped gripper 24 is bent at an angle to the back 92 so that it is roughly parallel with the base 82. The top 94 includes a tip 96 which, when the cylinder is reversed, may engage a hooked end of the trailing edge of the printing plate 12 just as the tip 56 of the gripper 26 engages the hook 58 of the trailing edge 52 of the printing plate 12.

The movable members 20 and 22 are biased into engagement with the pivotal surfaces 34 and 36 by a spring 64. The spring 64 is also effective, as noted above, to bias the movable members into either one of their upper and lower extreme positions regardless of the position of the other movable member. The spring 64 extends along the axial length of the movable members and in cross section comprises a generally U-shaped main body 100 and distal end portions 102 and 104 which extend generally perpendicular to the central axis of the main body portion. The distal ends 102 and 104 are received in arcuate recesses 108 and 109 formed in the sides 110 and 111 of the movable members 20 and 22 opposite from the tips 30 and 32, respectively. The recesses 108 and 109 extend along the entire axial length of the movable members 20 and 22. The spring 64 is formed to apply adequate force to secure the printing plate 12 to the plate cylinder, the force being uniformly distributed along the width of the printing plate. In this way, the lockup mechanism 10 applies a predetermined tension to the plate which holds the plate securely to the cylinder 14.

The shape of the main body portion 100 of the spring 64 is selected to protect the spring during installation. When the plate lockup mechanism is being assembled, the movable members 20 and 22 are positioned to the slot 16 before the spring 64 is installed. To install the spring 64, it is gripped with a tool similar to a pair of long-nose pliers to compress it so that it may be inserted axially into the slot 16 with the distal end portions 102 and 104 aligned with the recesses 108 and 109. The curve and shape of the main body 100 of the spring 64 is selected so that the stress applied to the spring during assembly cannot exceed the elastic limit of the spring. In this way, even if the upper ends 112 and 114 of the main body 100 are brought into contact with each other while compressing the spring 64, no permanent set or deformation of the spring can occur. The length of the distal end portions 102 and 104 is then selected so that they can make contact with the recesses 108 and 109 while the main body 100 of the spring 64 has the desired curvature and shape.

As noted above, the spring 64 not only presses the movable members 20 and 22 into the pivotal surfaces 34 and 36 of the slot 16, but also the spring gives a toggle effect to the movable members. This can be understood by considering the forces applied to the movable member 20 by the spring 64 in each of the possible positions of the movable members 20 and 22. With the movable member 20 in its lower extreme position (FIG. 2) and the movable member 22 is in its upper extreme position, the effective point of application of the spring force to the movable member 20 is indicated at point 120 and the effective point of application of the spring force to the member 22 is indicated at 122. The force of the spring is applied in the direction of a line connecting these two points 120 and 122, and the moment or torque applied by the spring to the movable member 20 is the product of the spring force and the distance between the line of force of the spring force and the point of contact between the tip 30 and the pivotal surface 34 when measured along a line normal to the line of action of the spring force. It is clear that this moment tends to turn the movable member 20 in a clockwise direction, thus biasing it into its lowermost position as shown. Similarly, the spring force applied to the movable member 22 when that member is in its uppermost position (FIG. 2) tends to bias the movable member 22 toward its uppermost position. It will be readily understood from considerations of symmetry that the force analysis applicable to FIG. 2 is also applicable to the arrangement of the movable members 20 and 22 illustrated in FIG. 4.

When both the movable members 20 and 22 are in their uppermost extreme position as shown in FIG. 3, the spring 64 biases both members against movement away from their uppermost positions. Again, an analysis of the direction of the applied forces makes this result clear. The force of the spring 64 is applied in a direction of a line connecting the effective points of application of the spring force shown at 120 and 122 (FIG. 3). The line of action of the force applied by the spring 64 to the movable member 20 passes above (as viewed in FIG. 3) the point of contact between the tip 30 of the movable member 20 and the pivotal surface 34 in the slot 16. For this reason the spring force applies a moment tending to turn the movable member 20 in a counterclockwise direction and biases the movable member 20 toward its upper position. Similarly, the line of action of the force applied by the spring 64 to the movable member 22 extends above (as viewed in FIG. 3) the point of contact between the tip 32 of the movable member 22 and the pivotal surface 36 of the slot 16. Therefore, the spring force applied to the movable member 22 tends to move the movable member 22 in a clockwise direction, thus biasing it toward its uppermost position.

Generalizing from the above, it can be seen that when the movable members 20 and 22 are in opposite positions, the line of action of the force on the spring 64 tends to cause the member 20 to rotate about its tip 30 in one direction and the member 22 to rotate about its tip 32 in the same direction. Further, when the movable members 20 and 22 are both in either their upper extreme positions (FIG. 3) or their lower extreme positions (not illustrated) the spring 64 causes them to rotate about their tips 30 and 32 in opposite directions.

In alternative to the above arrangement, the movable members 20 and 22 are shaped so that they are never biased toward their upper positions, instead the spring 64 always biases them downward. In such an embodiment the hooked leading end 40 of the printing plate 12 would hold itself in place by being hooked over the edge 42 of the slot 16. A shifting mechanism 130 (discussed below) lifts the movable members 20 and 22 to attach or release a printing plate 12. In this variation a larger tension could be applied to the plate using lighter springs, and in some applications this could be advantageous.

Figure 5:
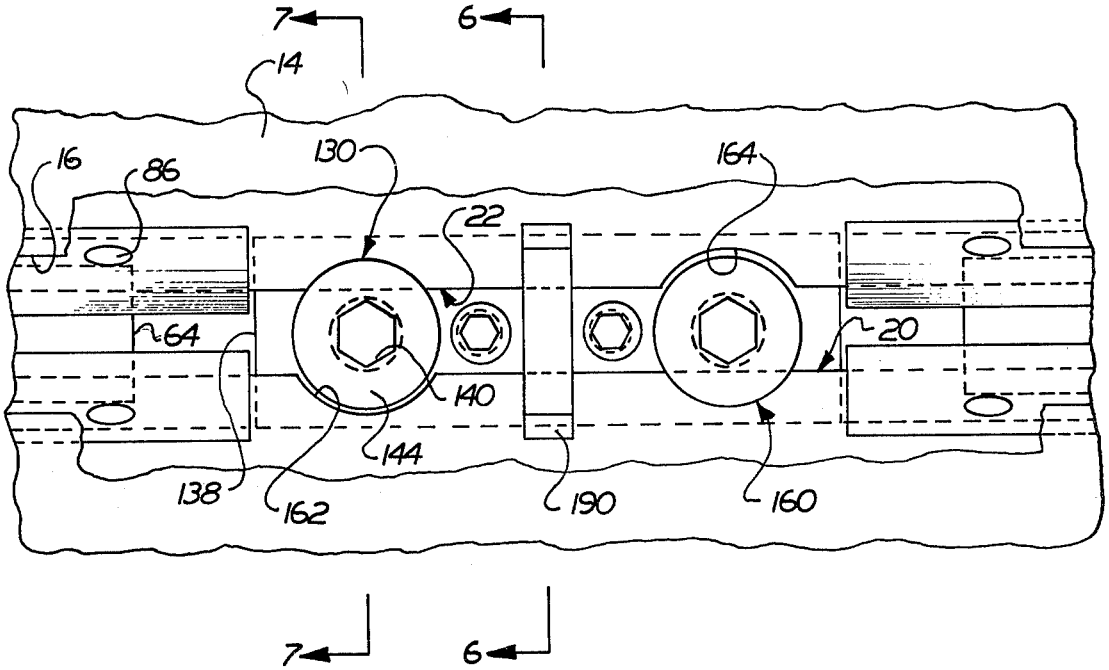
FIG. 5 is a plan view of a portion of the printing cylinder illustrated in FIG. 1 with portions of the printing cylinder cut away to illustrate an actuating mechanism for the plate lockup mechanism of the present invention.
Figure 6:
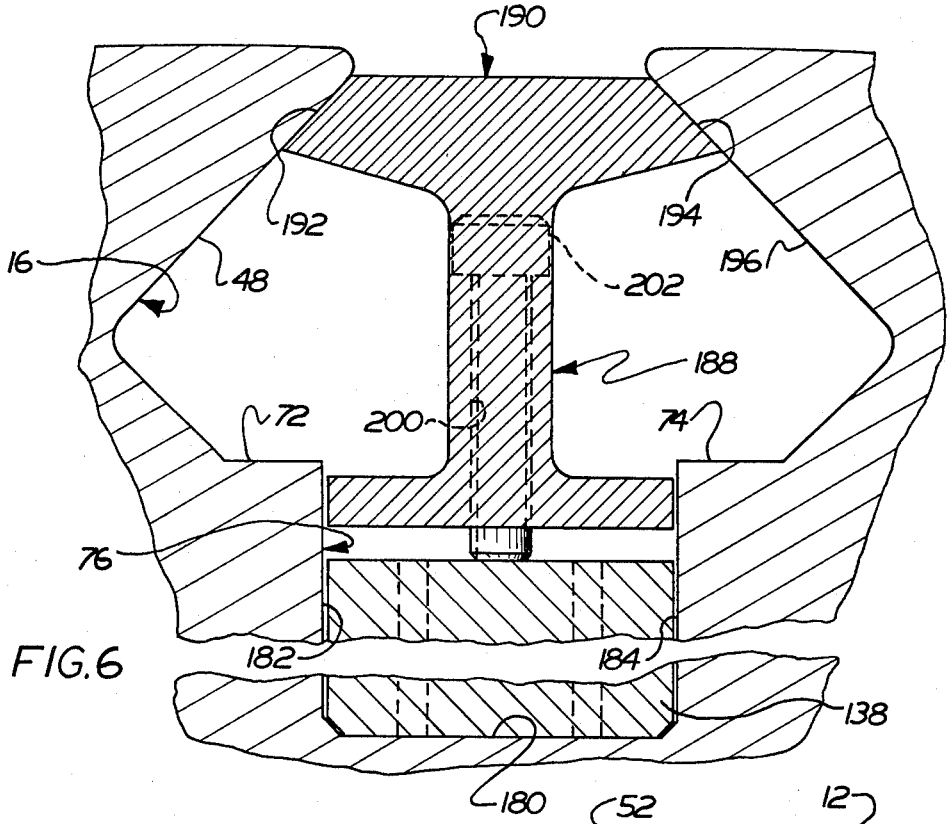
FIG. 6 is a sectional view taken along line 6—6 of FIG. 5.
Figure 7:
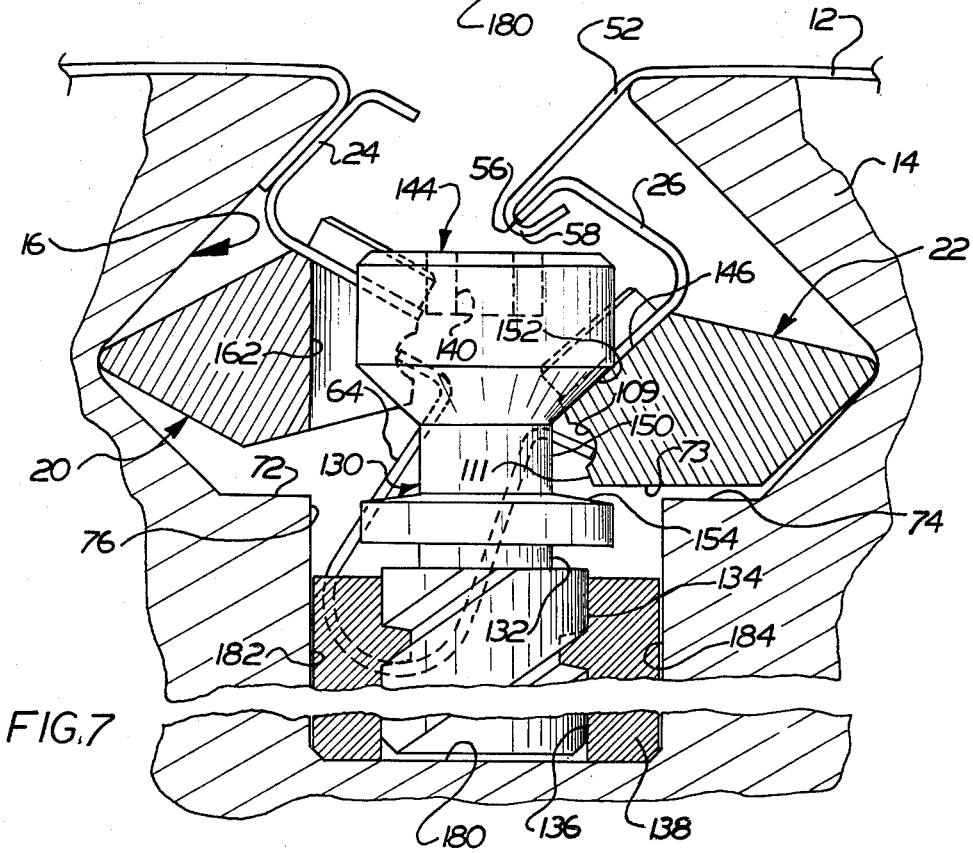
FIG. 7 is a sectional view taken along line 7—7 of FIG. 5.

FIGS. 5, 6 and 7 illustrate details of the construction of the shifting mechanism 130 used to shift the position of the movable member 22 and an identical shifting mechanism 160 used to shift the position of the movable member 20. The primary purpose of the shifting mechanism 130 and 160 is to position the movable members 22 and 20 and to limit their snapping toggle action as described below. In the extreme locking positions, the spring 64 provides the holding and tension forces necessary to secure the plate 12 as previously described. The shifting mechanism 130 comprises a shaft 132 (FIG. 7) which has a threaded end portion 134 which is received in a threaded passage 136 in a block 138. The threads formed in the threaded end portion 134 of the shaft 132 and the threaded passage 136 are twin lead threads with a relatively steep lead angle so that a relatively small rotation of the shaft 132 produces a relatively large axial motion. The shaft 132 is provided with a hexagonal socket 140 into which a suitable tool may be inserted to rotate the movable member. The socket 140 is aligned between the edges 42 and 66 (FIGS. 2–4) of the slot 16 in the surface of the cylinder 14.

The upper end portion 144 of the shaft 132 is adapted to engage two sides 73 and 146 of the movable member 22. These sides 73 and 146 of the movable member 22 are adjacent opposite edges of the surface 111 in which the recess 109 is formed. The upper end portion 144 of the shaft 132 has an annular recess 150 formed in its exterior surface. One side 152 of the annular recess 150 abuts the surface 146 of the movable member 22 when the shaft 132 is rotated to draw it radially inward toward the center of the cylinder 14. This in turn is effective to shift the movable member from its uppermost position illustrated in FIG. 2 to the lower position illustrated in FIG. 7.

To return the member 22 to its uppermost position, the shaft 132 is rotated in the opposite direction. In this case, the side surface 154 of the annular recess 150 in the upper end portion 144 of the shaft 132 engages the surface 73 of the movable member 22 and lifts it upward.

The side surfaces 152 and 154 of the annular recess 150 in the shaft 132 are designed to limit the snapping toggle action of the movable member 22 from one extreme position to the other caused by the spring 64. For example, when moving the movable member 22 upward from the position illustrated in FIG. 7, the surface 154 on the shaft 132 contacts the surface 73 of the movable member 22. Rotation of the shaft 132 in the appropriate direction lifts the movable member 22 until it reaches a center position on one side of which the spring 64 bias the member towards the lower position and on the other side of which the spring 64 biases the member 22 toward its upper position. As soon as the center position is crossed, the spring 64 urges the movable member 22 upward. The extent of free motion of the movable member 22 is limited by surface 152 of the shaft 132 which then engages the surface 146 of the movable member 22. In this way, the side surfaces 152 and 154 of the recess 150 formed in the upper end portion 144 of the shaft 132 control the snap action of the spring 64. This is particularly important when moving the gripper 26 downward into engagement with the bent-over hook 58 of the trailing end 52 of the printing plate 12. If the downward motion of the member 22 is not controlled, the abrupt engagement of the tip 56 of the gripper 26 with the hooked end 58 of the printing plate 12 can distort or unbend the end of the printing plate.

The movable member 22 (FIG. 5) is provided with an arcuate recess 162 which permits the upper end portion 144 of the shaft 132 to move axially without contacting the movable member 20. A similar arcuate recess 164 is formed in the movable member 20 which enables the shaft associated with the shifting mechanism 160 to move axially without contacting the movable member 22. In this way, the shifting mechanisms 130 and 160 may operate to shift the movable members 22 and 20, respectively, between their extreme positions each one independently of the other.

Figure 9:
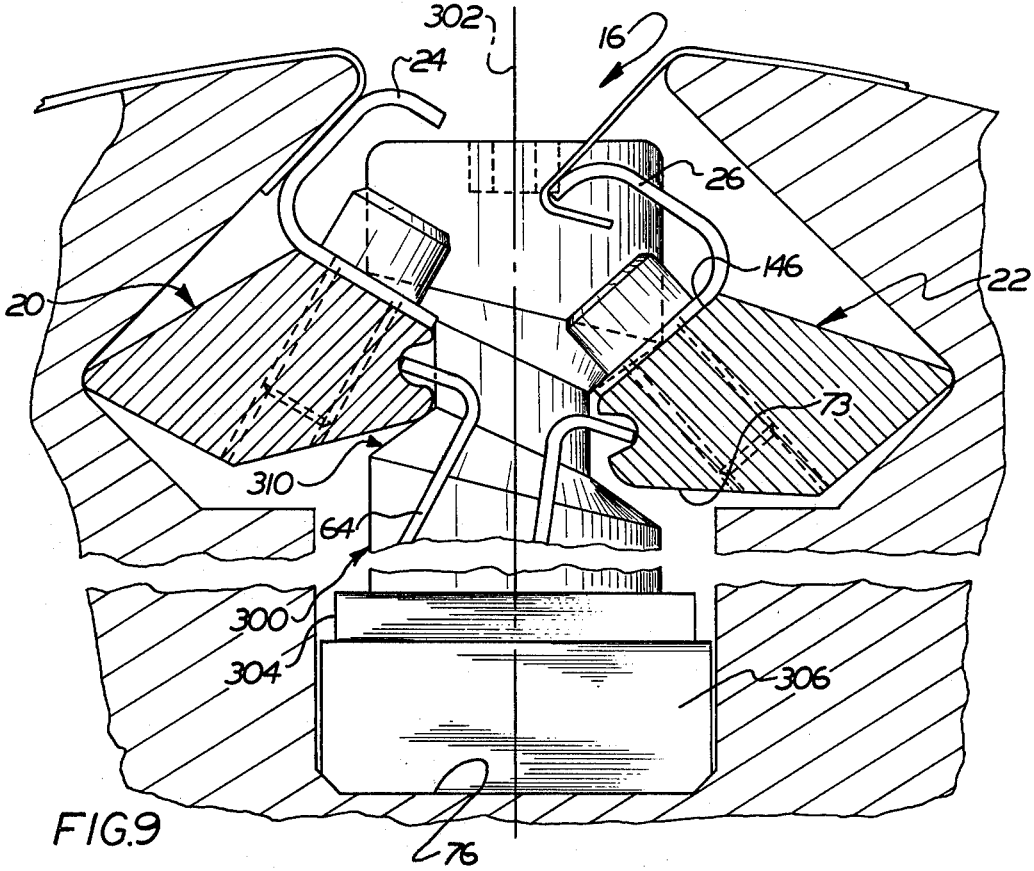
FIG. 9 is an illustration generally similar to FIG. 7 but showing an alternative actuating mechanism.

The shifting mechanism 130 illustrated in FIGS. 5, 6 and 7 includes the shaft 132. However, the particular design for the shaft 132 shown is not the only such design contemplated or conceivable. Another design is illustrated in FIG. 9 in which similar numerals are used to designate similar parts. In the embodiment illustrated in FIG. 9 the shaft 132 has been replaced by the shaft 300. The shaft 300 is rotatable about an axis 302 bisecting the slot 16, and the shaft is held against axial movement along the axis of rotation by a suitable bearing arrangement 304. The bearing arrangement 304 is received in a block 306 which is held in the radially inner portion 76 of the slot 16 by means to be described below.

The shaft 300 includes a cam groove or recess 310 which circumscribes the outside surface of the shaft and in which the movable members 20 and 22 are received. The plane of the cam groove 310 is not perpendicular with the axis of rotation 302 so that when the shaft 300 is rotated, the groove 310 forms a cam surface which raises and lowers the movable members 20 and 22. The movable members 20 and 22 are raised and lowered by individual shafts 300.

Returning to the shifting mechanism 130 illustrated in FIGS. 5, 6, and 7, the radially inner, threaded end portion 134 of the shaft 132 is received in a threaded passage 136 in a block 138. The block 138 (FIG. 6) is received in the radially innermost portion 76 of the slot 16 which is shaped to fit the block and to provide clearance for the spring 64. The radially innermost portion 76 of the slot 16 is generally U-shaped having a bottom surface 180 and opposite parallel side surfaces 182 and 184 which are contiguous with surfaces 72 and 74, respectively.

The block 138 is a sliding fit into the U-shaped portion 76 of the slot 16. The block 138 is secured in place by a clamp arrangement 188 shown in FIG. 6. The clamp arrangement 188 includes a T-shaped member 190 which is received within the slot 16. The member 190 can serve as a register pin and in addition has surfaces 192 and 194 which abuttingly engage the undercut sides 48 and 196 of the slot 16. A threaded passage 200 through the block receives a cap screw 202. When the block 138 has been positioned in the slot 16, the T-shaped member 190 is placed above it and the threaded members 202 are tightened. This forces the surfaces 192 and 194 of the T-shaped member against the sides 48 and 196 of the slot 16 and also forces the block 138 downward against the bottom surface 180 of the radially innermost portion of the slot 76. In this way the clamp arrangement 188 serves to firmly position the block 138 within the slot 16. The block 306 illustrated in FIG. 9 is held in the slot 16 in the same way.

Spring 64 retains members 20 and 22 in the cylinder body 14. Screw 202 wedges register pin 190 securely in the body and at the same time secures base 138. Thus, there is no need for tap holes and retaining screws in the cylinder body which can become corroded or stripped. This factor makes lockup maintenance quicker and less troublesome.

Figure 8:
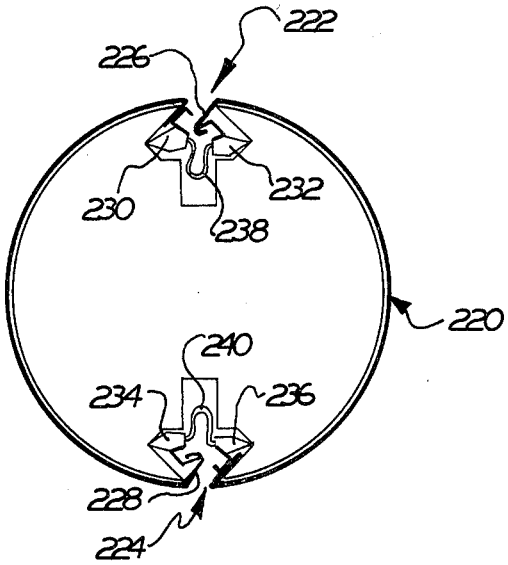
FIG. 8 is an end view of a cylinder having two plate lockups constructed according to the present invention.

FIG. 8 illustrates a printing cylinder 220 equipped with two plate lockup mechanisms 222 and 224 so that two circumferentially spaced plates 226 and 228 may be secured to the cylinder. The lockups 222 and 224 are in slots in the cylinder 220 located diametrically opposite each other. The plate lockup mechanisms 220 and 222 are both identical to the plate lockup mechanism 10 described above and shown in FIGS. 1–5.

When attaching plates 226 and 228 to a cylinder such as cylinder 220 to which two (or more) separate plates are to be attached, it is desirable that the plate lockup for each end of a plate be operable independently of the lockups securing the ends of the other plate(s) to the cylinder. The plate lockups 222 and 224 achieve this goal because the movable members 230 and 232 which are part of lockup 222 and the movable members 234 and 236 which are part of lockup 224 are independently actuated, and each is biased to either of its extreme positions by the biasing springs 238 and 240 regardless of the position of the other movable member of the lockup mechanism.

Figure 10:
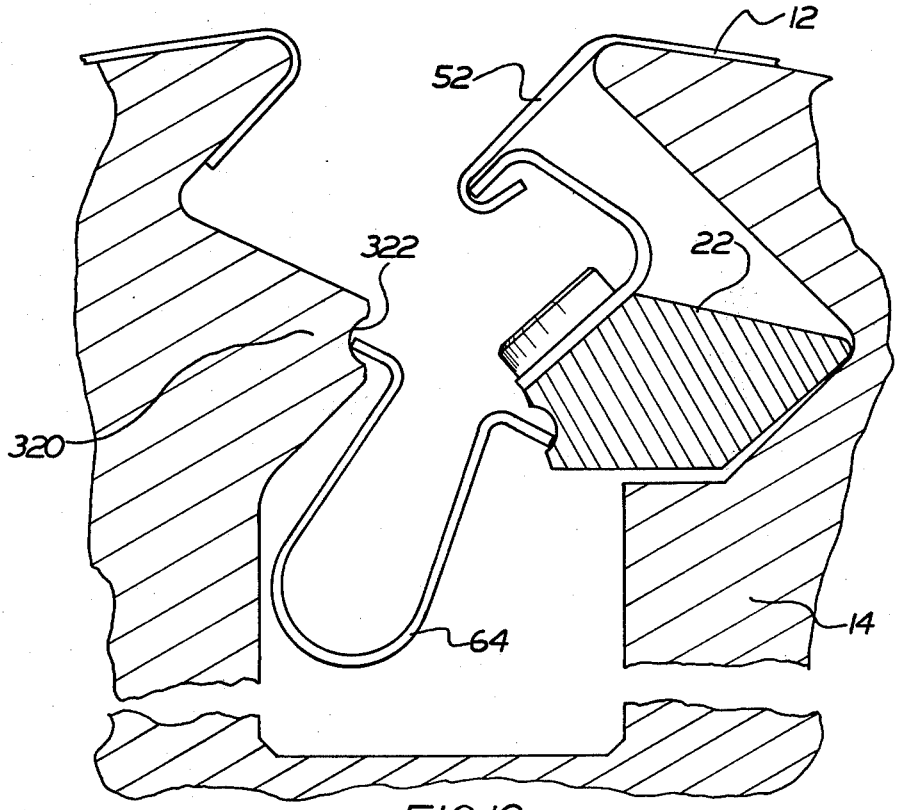
FIG. 10 illustrates another preferred embodiment of the present invention.

Other variations of the present invention are contemplated. In FIG. 10 a single-sided lockup is disclosed. In this lockup one of the movable members 20 has been replaced by a projection 320. The projection 320 includes a recess 322 in which one distal end portion 102 of the spring 64 is received. The movable member 22 operates in the same manner as in previously disclosed embodiments. Of course, the embodiment disclosed in FIG. 10 operates only on the trailing edge 52 of the printing plate 12, and may not lend itself to applications where the direction of rotation of the cylinder 14 is reversible.

Figure 11:
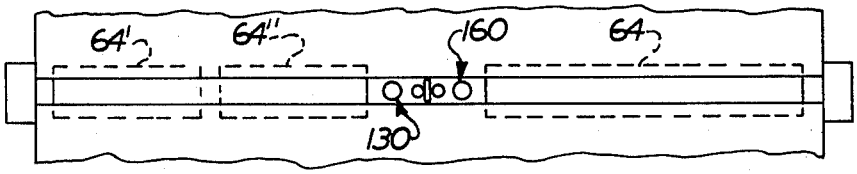
FIG. 11 is a plan view of the printing cylinder of FIG. 1 and illustrating both a single spring and a double spring arrangement.

Variations in the spring 64 are also contemplated. For example, one or more springs 64 may be used on each side of the shifting mechanisms 130 and 160. FIG. 11 illustrates two different spring arrangements. On the right of the shifting mechanism 160 a single spring 64 is utilized, while to the left of the shifting mechanism 130 two separate springs 64' and 64'' are utilized. All the springs 64, 64' and 64'' have the same shape and differ only in length. The choice of configurations may depend on factors such as ease of manufacturing the springs 64, 64' and 64'' and the tension force desired to be applied to the plate 12.

Figure 12:
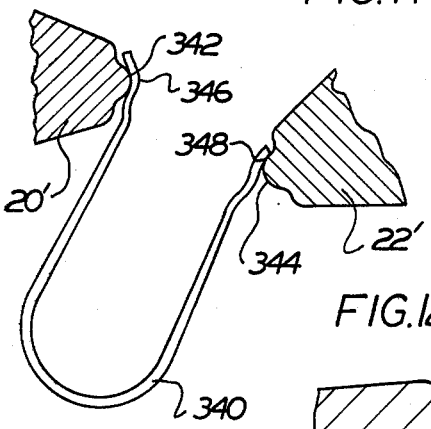
FIGS. 12 and 13 illustrate other preferred embodiments of the present invention, particularly different springs suitable for use in the present invention.

Additionally, the biasing spring itself may take different forms. FIG. 12 illustrates a U-shaped spring 340 which extends between the movable members 20' and 22'. In this embodiment the movable members 20' and 22' are provided with axially extending ridges 342 and 344, respectively, in place of the recesses 108 and 109 utilized in previous embodiments. The spring 340 is provided with bends 346 and 348 in which the ridges 342 and 344, respectively, are received.

Figure 13:
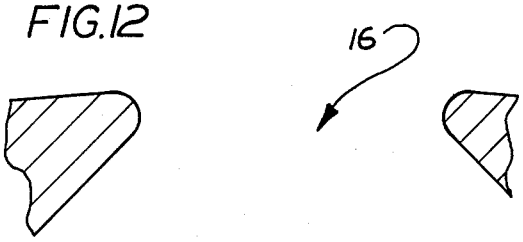
Figure 13:
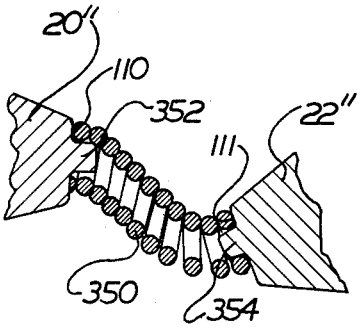

FIG. 13 illustrates another possible spring arrangement. In this embodiment a series of coil springs 350 extend between the movable members 20'' and 22''. The end faces 110 and 111 of the movable members 20'' and 22'' are each provided with a series of cylindrical projections 352 and 354 which are received within the ends of the springs 350. The projections 352 and 354 may be a tight fit within the springs 350, and they serve to position the springs on the movable members 20'' and 22''.

Figure 14:
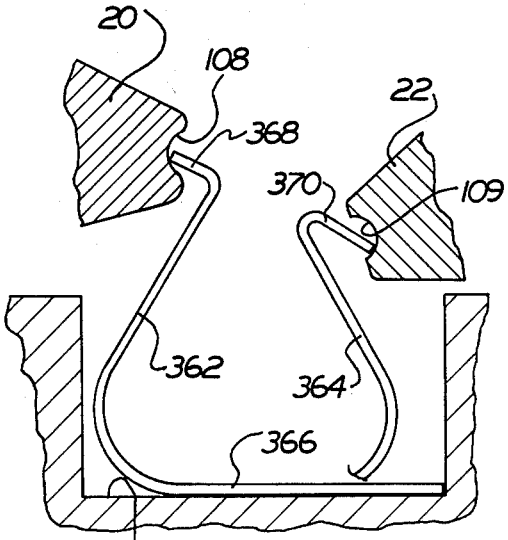
FIG. 14 illustrates another preferred embodiment of the invention.

Another variation of springs is shown in FIG. 14. In this embodiment a separate series of springs 362 and 364 bias the movable members 20 and 22 individually. The series of springs 362 and 364 are arranged axially and alternate with each other. Each spring in each series 362 and 364 has a flat base 366 bearing against the bottom 180 of the slot 16. Each spring in each series 362 and 364 is otherwise similar to the spring 64 described in FIGS. 1–10 and each has a distal end 368 and 370 disposed in a corresponding recess 108 and 109 in the movable members 20 and 22.

Thus, it is clear that the present invention provides a new and improved plate lockup mechanism 10 which is effective to secure and accurately position a printing plate 12 on a printing cylinder 14. Further, the plate lockup mechanism 10 provides a uniformly predetermined tension to the printing plate and permits a relatively small gap 16 in the surface of the printing cylinder 14. Because of the symmetry of the plate lockup mechanism 10, it is equally effective in securing a printing plate 12 to the cylinder 14 when the rotation of the cylinder is clockwise as when it is counterclockwise.

The present invention provides a plate lockup mechanism 10 (FIG. 2) comprising an axially extending slot 16 in the surface of a printing cylinder 14. The edges 42 and 66 of the slot 16 are undercut and two movable members 22 and 24 are disposed within the slot, one on each side. Grippers 24 and 26 are associated with each of the movable members 20 and 22, and each gripper is effective to engage one end portion 40 or 52 of a printing plate 12. The member 20 on the leading side of the slot 16 and the gripper 24 attached to it serve to engage the leading end portion 40 of the printing plate 12 to hold it in place, while the member 22 on the trailing edge of the slot and the gripper 26 attached to it serve to apply a predetermined tension to the printing plate.

Each of the movable members 20 and 22 are identical to each other and are arranged to move on paths which are symmetrical about a radial line bisecting the slot 16. the movable members 20 and 22 each have a slightly rounded tip or apex 30, 32, and these tips are received in an opposing concavely curved portions 34 and 36 of the slot 16 in the cylinder 14. Each of the members 20 and 22 is pivotable about its tip 30 and 32, respectively, between upper and lower extreme positions.

The leading edge 40 of the printing plate 12 may be hooked over the leading edge 42 of the slot 16 when the member 20 is in its lower extreme position (FIG. 2). When the member 20 is pivoted to its upper extreme position (FIG. 3), the gripper 24 presses the plate 12 against the side 48 of the slot 16 to secure it in place. The trailing edge 52 of the printing plate 12 may be inserted into the slot 16 when the member 22 on that side of the slot is in its upper position (FIG. 3). Thereafter, the member 22 is pivoted toward its lower position (FIG. 4) to bring the gripper 26 into engagement with the hook 58 formed in the trailing edge of the printing plate. The gripper 26 then applies a predetermined pressure to the printing plate.

The members 20 and 22 are biased to either of their extreme positions by a single spring 64 which coacts between them. The spring 64 acts against each of the members 20 and 22 so that each member has a toggle action, moving over a center position between the two extreme positions. Thus, if one of the members, e.g., the leading member 20, is in its upper position (FIG. 3) the spring 64 applies a force to bias it into that position. But, once that member is moved over center toward its lower position, the spring 64 will apply a biasing force urging the member toward the lower position (FIG. 2). The spring 64 is effective in this way regardless of the position of the other member, in this example, the member 22. The actuator mechanisms 130 and 160 cushion against excessive snap-action as the movable members 20 and 22 move over center, and thus protect the printing plate 12 from distortion. Once the extreme positions are attained, the actuator mechanisms 130 and 160 do not provide a force to secure the plate 12. Rather, the spring 64 provides the forces necessary to hold and secure the printing plate 12.

The plate lockup mechanism of the present invention is effective regardless of the direction of rotation of the cylinder 14, and no modifications are required when the direction of cylinder rotation is reversed. The slot 16 in the cylinder 14 is symmetrical about a radial line and the two movable members 20 and 22 are mirror images of each other. For this reason, a single spring 64 coacting between the two members 20 and 22 is effective to enable each member to act as a toggle regardless of the position of the other member. Further, the grippers 24 and 26 associated with each member are identical and are symmetrical with each other about a radial line bisecting the slot 16 when the movable members are both in either their upper or lower extreme positions. The grippers each have a flat portion 46 to press the leading edge 40 of the printing plate 12 against a side 48 of the slot 16 and a hooked portion 56, 96 to engage the hooked trailing edge 58 of the printing plate. In this way, either gripper 24 or 26 may engage the leading edge of a printing plate, and either gripper may engage the trailing edge of the printing plate, thus making the plate lockup mechanism 10 reversible.

What is claimed is:

1. A plate lockup mechanism for use in a printing cylinder to secure a printing plate thereto, said mechanism comprising first and second movable members disposed on the printing cylinder, means associated with said first movable member for engaging one end portion of a printing plate, means associated with said second movable member for engaging a second end portion of the printing plate, pivot means enabling said first movable member to rotate between two extreme positions about a first axis generally parallel with the one end portion of the printing plate, pivot means enabling said second movable member to rotate between two extreme positions about a second axis generally parallel with the second end portion of the printing plate, said first and second axes of rotation of said movable members defining a plane, and biasing means engaging said first and second movable members and urging them away from each other, said movable members being movable between a first position in which said biasing means applies a torque to said first member tending to rotate said first member about said first axis in a first direction and a torque to said second member tending to rotate said second member about said second axis in said first direction, and a second position in which said biasing means applies a torque to said first member tending to rotate said first member about said first axis in a second direction and a torque to said second member tending to rotate said second member about said second axis in said second direction, and wherein when said movable members are in either of said first and second positions the line of action of the force applied by said biasing means intersects said plane defined by said first and second axes of rotation of said movable members between said axes of rotation of said movable members, said movable members being further movable to a third position in which the line of action of said biasing means is free of intersection with said plane between said first and second axes to thereby apply a torque to said first member tending to rotate said first member about said first axis in said second direction and a torque to said second member about said second axis in said first direction.

2. A mechanism as set forth in claim 1 wherein said first and second movable members are identical.

3. A mechanism as set forth in claim 1 wherein said means associated with each of said movable members for engaging one end portion of a printing plate includes means for pressing one end portion of a printing plate against a wall which at least partially defines a slot in the printing cylinder to thereby limit relative motion between said wall and said printing plate and means for applying tension to the other end portion of the printing plate.

4. A mechanism as set forth in claim 3 wherein said means for pressing one end portion of a printing plate against a wall of the slot includes a first resilient member connected with said first one of said movable members and said means for applying tension to a second end portion of the printing plate includes a second resilient member connected with said second movable member, said first and second resilient members being identical.

5. A mechanism as set forth in claim 4 wherein said first and second movable members are identical.

6. A mechanism as set forth in claims 1 further including means for individually shifting each one of said movable members between said first and second extreme positions.

7. A plate lockup mechanism for securing a printing plate to a printing cylinder, said mechanism including two movable members disposed within the printing cylinder, means connected with one of said members for engaging one end portion of the printing plate to secure the one end portion of the plate on the cylinder, means connected with the other of said members to secure the other end of the plate to the cylinder, each of said members being movable between first and second extreme positions, and biasing means coacting between said two members, for urging one of said members to either one of said extreme positions when the other member is in said first extreme position and when the other member is in said second extreme position, said mechanism further including two pivotal surfaces within the printing cylinder, one of said members having surface means for engaging one of said pivotal surfaces, the other of said members having surface means for engaging the other of said pivotal surfaces, said biasing means including means for simultaneously urging said surface means on both of said members into engagement with a respective one of said pivotal surfaces, said biasing means comprising a leaf spring having a generally U-shaped main body portion and two distal end portions extending outward transverse to the central axis of said main body portion, one of said distal end portions engaging one of said members and the other of said distal end portions engaging the other of said members.

8. A mechanism as set forth in claim 7 wherein the central axis of said main body of said spring is skewed in one direction with respect to a line connecting said pivotal surfaces when one of said members is in its first extreme position and the other of said members is in its second extreme position and skewed in an opposite direction with respect to the line connecting said pivotal surfaces when the one of said members is in its second extreme position and the other of said members is in its first extreme position.

9. A plate lockup mechanism for use in a printing cylinder to secure a printing plate thereto, said mechanism comprising first and second movable members disposed on the printing cylinder, means associated with said first movable member for engaging one end portion of a printing plate, means associated with said second movable member for engaging a second end portion of the printing plate, pivot means enabling said first movable member to rotate between two extreme positions about a first axis generally parallel with the one end portion of the printing plate, pivot means enabling said second movable member to rotate between two extreme positions about a second axis generally parallel with the second end portion of the printing plate, said first and second axes of rotation of said movable members defining a plane, and biasing means engaging said first and second movable members and urging them away from each other, said movable members being movable between a first position in which said biasing means applies a torque to said first member tending to rotate said first member about said first axis in a first direction and a torque to said second member tending to rotate said second member about said second axis in said first direction and a second position in which said biasing means applies a torque to said first member tending to rotate said first member about said first axis in a second direction and a torque to said second member tending to rotate said second member about said second axis in said second direction, when said movable members are in either of said first and second positions the line of action of the force applied by said biasing means intersects said plane defined by said first and second axes of rotation of said movable members between said axes of rotation of said movable members, said movable members being further movable to a third position in which the line of action of said biasing means is free of intersection with said plane between said first and second axes to thereby apply a torque to said first member tending to rotate said first member about said first axis in said second direction and a torque to said second member tending to rotate said second member about said second axis in said first direction, each of said movable members being formed of an axially extending prism and said pivot means including surface means on each of said prisms defining an axially extending edge having a convexly curved surface and surface means within the cylinder defining two axially extending concavely curved surfaces, the axis of rotation of each of said movable members being defined by the line of contact between said concavely and convexly curved surfaces.

10. A mechanism as set forth in claim 9 further including a slot formed in the surface of the printing cylinder and in which said first and second movable members are disposed, said slot being symmetrical about a radial line bisecting said slot and including surface means for limiting the extent of rotation of each of said movable members.

11. A mechanism as sets forth in claim 10 wherein said slot forms a narrow gap in the surface of the cylinder and undercut surfaces extend between the edges of said gap and said concavely curved surfaces.

12. A plate lockup mechanism comprising a plate cylinder rotatable about its longitudinal axis, a slot in said cylinder, said slot forming a gap in the surface of said cylinder and having an undercut portion with an axially extending concavely curved recess, an axially extending movable member disposed in said slot, gripper means connected to said movable member for engaging one end portion of a printing plate, said movable member having a convexly curved tip, said movable member pivoting about the line of contact between said tip and said recess to move sid gripper means between plate gripping and plate releasing positions, said mechanism further including biasing means for biasing said tip of said movable member into engagement with said recess in said slot and for urging said movable member to pivot toward said plate gripping and toward said plate releasing positions, said biasing means including a spring and said movable member including an axially extending convexly curved ridge opposite from said tip, said spring having a cooperating concavely curved portion disposed in engagement with said ridge.

* * * * *